US006373201B2

(12) United States Patent
Morgan et al.

(10) Patent No.: US 6,373,201 B2
(45) Date of Patent: Apr. 16, 2002

(54) RELIABLE LAMP LIFE TIMER

(75) Inventors: Daniel J. Morgan, Denton; Thomas E. Smith, Plano, both of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/745,332

(22) Filed: Dec. 21, 2000

Related U.S. Application Data

(60) Provisional application No. 60/173,345, filed on Dec. 28, 1999.

(51) Int. Cl.[7] ..... G05F 1/00

(52) U.S. Cl. ..... 315/291; 315/292; 315/307; 315/225; 315/360

(58) Field of Search ..... 315/291, 292, 315/293, 297, 307, 360, 209 R, 224, 225

(56) References Cited

U.S. PATENT DOCUMENTS 5,023,516 A * 6/1991 Ito et al. ..... 315/101
5,091,678 A * 2/1992 Chin-Song ..... 315/362
5,777,439 A * 7/1998 Hua ..... 315/225
6,211,620 B1 * 4/2001 Gyoten et al. ..... 315/106

* cited by examiner

*Primary Examiner*—Don Wong
*Assistant Examiner*—Tuyet T. Vo
(74) *Attorney, Agent, or Firm*—Charles A. Brill; Wade James Brady, III; Frederick J. Telecky, Jr.

(57) ABSTRACT

A method and apparatus for controlling a lamp. A timer (106) reads a rated safe life value from a memory (102) associated with a lamp in a lamp module (104). The memory (102) in the lamp module (104) contains a series of locations in which the rated safe life of the lamp has been stored, and a series of locations for storing the elapsed on time of the lamp. The timer controller (106) reads the series of locations storing the rated safe life of the lamp and verifies the validity of the values using a series of checksums and comparisons between the various values. The timer controller (106) also reads the series of locations storing the elapsed on time for the lamp and verifies the elapsed on time in a similar manner. If either the rated safe on time or the elapsed on time cannot be verified, the lamp is disabled. If both can be verified, and the lamp is enabled until the elapsed on time equals or exceeds the rated safe life.

10 Claims, 5 Drawing Sheets

FIG. 1
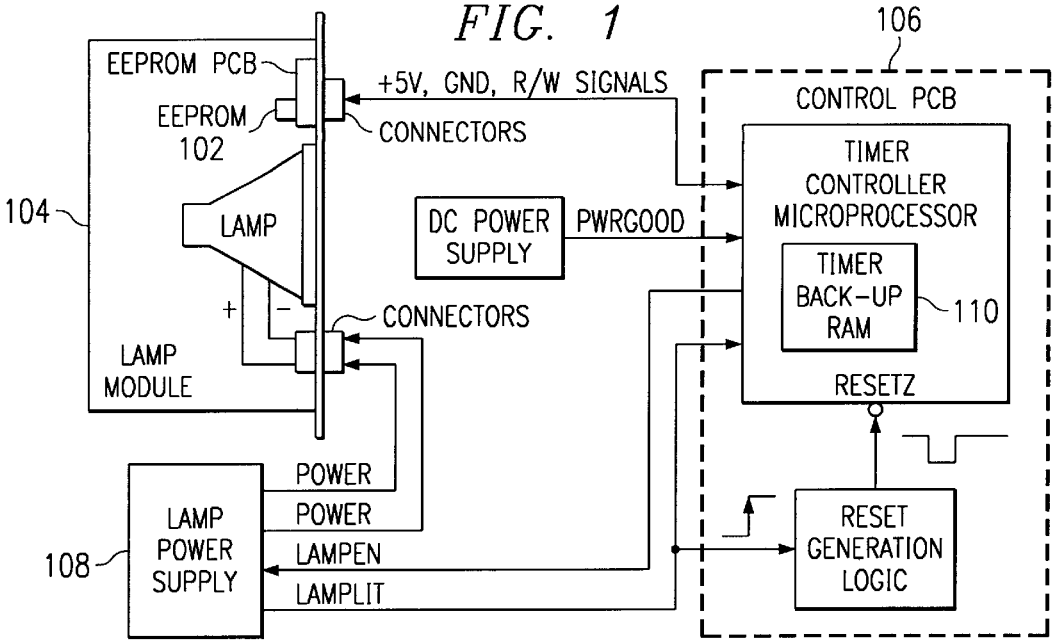
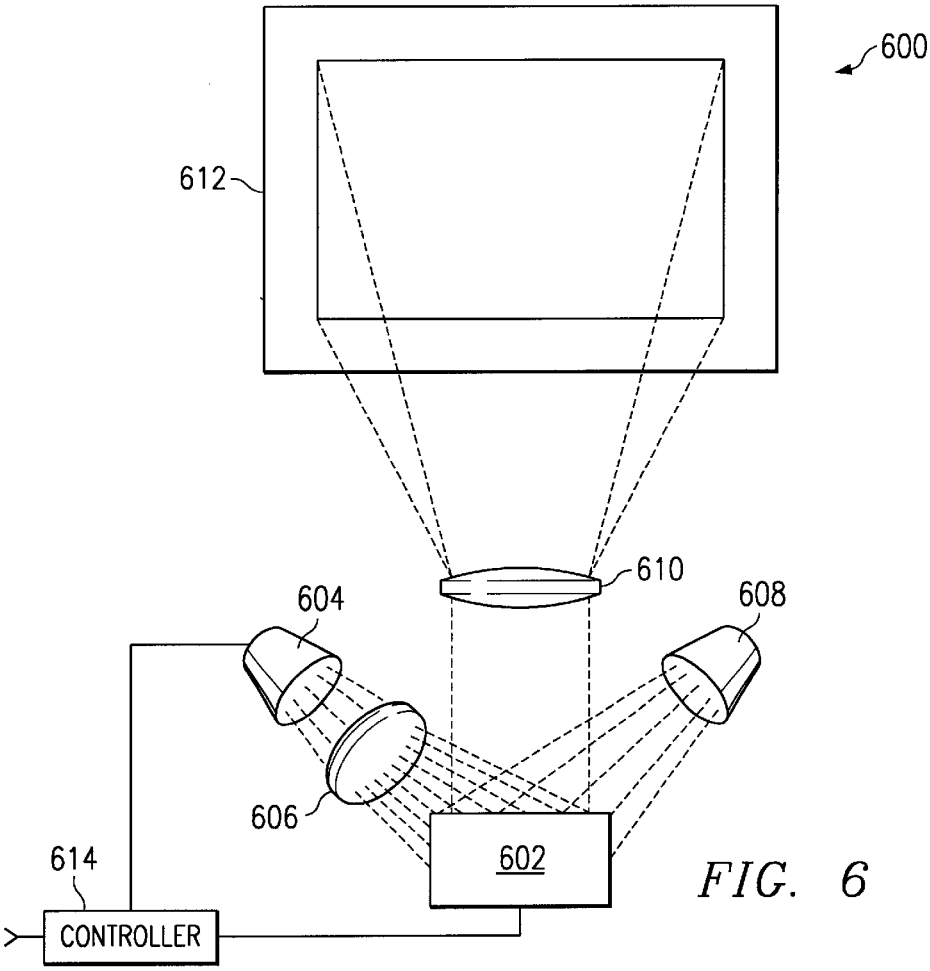
FIG. 6

RELIABLE LAMP LIFE TIMER

This application claims priority under 35 USC §119(e) (1) of provisional application No. 60/173,345 filed Dec. 28, 1999.

FIELD OF THE INVENTION

This invention relates to the field of display systems, more particularly to lamp timers used by projection display system.

BACKGROUND OF THE INVENTION

Display system manufacturers are under increasing competitive pressure to improve the brightness of their displays. Bright displays are much more appealing to consumers. Brighter projectors can project larger images, a very desirable feature in the consumer projection display market. Bright projected images are easier to see, especially in venues that suffer from a high ambient light level.

High pressure arc lamps provide a very bright light source and enable projection display systems to produce high quality bright images. Unfortunately, high pressure arc lamps degrade with usage and have a finite rated lamp life. By the end of the rated lamp life, the high pressure lamp is typically only half as bright as it was at the beginning of its life. Thus, the image quality of a display using a typical high pressure lamp degrades over time. While many consumers will replace the lamp, many will continue to use the lamp and accept the degraded image.

High pressure lamps are an explosion hazard. The risk of explosion increases as the lamp is used, and most likely for lamps that are used past their rated lifetime. A lamp explosion easily can damage the projector, and explosion of some high pressure lamps, for example Xenon lamps, can send shrapnel through the projector housing and injure anyone in the vicinity of the projector.

Thus, the use of high pressure lamps poses a safety risk to the consumer. Safety is a primary concern when designing and manufacturing consumer electronics. Not only must the products be safe as designed and manufactured, but every effort is made to ensure the article remains safe even if it suffers a reasonable level of abuse or misuse at the hands of the consumer.

In many applications that use arc lamps, timers track the time the arc lamp is on and warn the operator to replace the bulb at the end of the lamp life—before risking an explosion. The timer resets each time the lamp is replaced, and warns the operator when to order a replacement lamp and when to install the replacement lamp. A simple timer is often sufficient in industrial applications where the operator has been trained to replace the lamp, knows to have replacement lamps on hand, and is generally concerned with keeping the equipment in peak operating condition.

Average consumers cannot be relied on to replace the lamps in home-use equipment. The consumer may not feel competent replacing the lamp, or may simply want to put off replacing the lamp until a more convenient time. This delay can easily lead to an eventual explosion of the lamp, harming the consumer and damaging the projector. To avoid this risk, displays using high pressure lamps may be designed to automatically shut down once the lamp timer reaches a predetermined value. The timers described above, however, are easily defeated merely by removing and replacing the lamp.

Another problem with a simple automatic timer involves determining the rated life time of a new lamp. Unless the display device can rely on assistance from the consumer, the display system must be preset with the rated lifetime of the lamp. If a display system is designed to accept more than one lamp model, the preset value must be the shortest life of any of the interchangeable lamps. This results in premature replacement of longer-life lamps. Furthermore, manufacturers often improve the design of a lamp over the course of production. While these design improvements can increase the rated lifetime of the lamp, if the expected lifetime of the lamp is hard wired in the projector, the benefits of the lamp improvements will not be realized.

More sophisticated timers could prevent the consumer from simply reinstalling the same bulb. These more sophisticated timers, however, must be able to operate in a very harsh environment. Not only does the lamp put off a large amount of heat, igniting the lamp arc creates huge electromagnetic impulses that can easily reset electrical circuits and overwrite ordinary electrical memory devices. What is needed is a reliable timer that is difficult to defeat or reset.

SUMMARY OF THE INVENTION

Objects and advantages will be obvious, and will in part appear hereinafter and will be accomplished by the present invention that provides a method and system for a reliable lamp life timer and method. One embodiment of the claimed invention provides a method of tracking the elapsed operating time of a light source. The method comprises the steps of: associating a memory device with a lamp, igniting the lamp, updating an elapsed lamp on time value stored in the memory, comparing the elapsed lamp on time to the rated lamp life value, repeating the updating and comparing steps until the elapsed lamp on time exceeds the rated safe life value, and disabling the lamp when the elapsed lamp on time exceeds the rated safe life value. Alternate embodiments store the values stored in multiple locations of the memory device, comparing the values read from the multiple locations, and rewrite inaccurate locations.

A display system comprising: a lamp, a memory device, a timer controller circuit, a spatial light modulator, and projection optics. The lamp for generating a beam of light along a light path. The memory device associated with the lamp and storing the rated safe life value. The timer controller circuit capable of reading the rated safe life value from the memory and storing an elapsed lamp on time value in the memory. The timer controller circuit disabling the lamp when the elapsed lamp on time value exceeds the rated safe life value. The timer controller circuit also disabling the lamp when either the elapsed lamp on time value or the rated safe life value become irretrievably corrupted. The spatial light modulator modulating the beam of light to produce a modulated beam of light that is focused on an image plane by the projection optics.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 is a block diagram of a novel lamp life timer according to one embodiment of the disclosed invention.

FIG. 6 is a schematic view of a display system implementing the novel lamp life timer of FIG. 1.

DETAILED DESCRIPTION OF THE PREFERRED EMBODIMENTS

A lamp timer and method of operation is disclosed that reliably tracks the cumulative operating time of a device, such as a high pressure lamp. The disclosed timer and method resist tampering and are insensitive to the high levels of electromagnetic interference (EMI) experienced by the lamp during burner ignition.

FIG. 1 is a block diagram of the disclosed timer circuit and associated display components. An electrically-erasable, programmable read only memory 102 (EEPROM) is contained in the lamp module 104 and electrically connected to a timer controller 106. The EEPROM 102 contains at least two data words—a rated safe-life value, and a word representing the elapsed operating time of the lamp.

The rated safe-life time is determined by the lamp manufacturer and is programmed into the EEPROM by the lamp manufacturer. The ideal EEPROM for this application should require a fairly complex string of commands to write to the EEPROM. Because lamp ignition generates an intense EMI field, a complex write setup routine helps to prevent erroneous data from being written to the EEPROM during the lamp ignition periods—increasing the reliability of the timer.

Ideally, the EEPROM has at least one portion of memory that can only be written to one time. This portion is used to hold the rated lamp life. An example of such an EEPROM is the 93LCS56 manufactured by Microchip. Table 1 is one possible memory map for such a device. As shown in Table 1, Block 0 of the device can only be written to once—by the manufacturer—and is used to hold information about the lamp design. Both the safe life and the rated lamp life are stored in Block 0, along with a lamp manufacturing serial number. A checksum for the safe life and rated lamp life values is also stored in Block 0.

TABLE 1

EEPROM Memory Map

| Block | Address Range | # of Words | Write Access | Description |
|---|---|---|---|---|
| 5 | 120–127 | 8 | Projector | Reserved |
| 4 | 119 | 1 | Projector | Checksum for Block 4 |
| 4 | 98–118 | 21 | Projector | Elapsed Lamp Life (7ea)<br>Rated Lamp Life (7ea)<br>Safe Life (7ea) |
| 3 | 97 | 1 | Projector | Checksum for Block 3 |
| 3 | 76–96 | 21 | Projector | Elapsed Lamp Life (7ea)<br>Rated Lamp Life (7ea)<br>Safe Life (7ea) |
| 2 | 75 | 1 | Projector | Checksum for Block 2 |
| 2 | 54–74 | 21 | Projector | Elapsed Lamp Life (7ea)<br>Rated Lamp Life (7ea)<br>Safe Life (7ea) |
| 1 | 53 | 1 | Projector | Checksum for Block 1 |
| 1 | 32–52 | 21 | Projector | Elapsed Lamp Life (7ea)<br>Rated Lamp Life (7ea)<br>Safe Life (7ea) |
| 0 | 25–31 | 7 | Lamp Mfg. | Lamp mfg. specific (serial number, etc.) |

TABLE 1-continued

EEPROM Memory Map

| Block | Address Range | # of Words | Write Access | Description |
|---|---|---|---|---|
| 0 | 24 | 1 | Lamp Mfg. | Checksum for Block 0, words (0–23) |
| 0 | 12–23 | 12 | Lamp Mfg. | Rated Lamp Life (screen lumens) |
| 0 | 0–11 | 12 | Lamp Mfg. | Safe Life (explosion safe time) |

Figure 3:
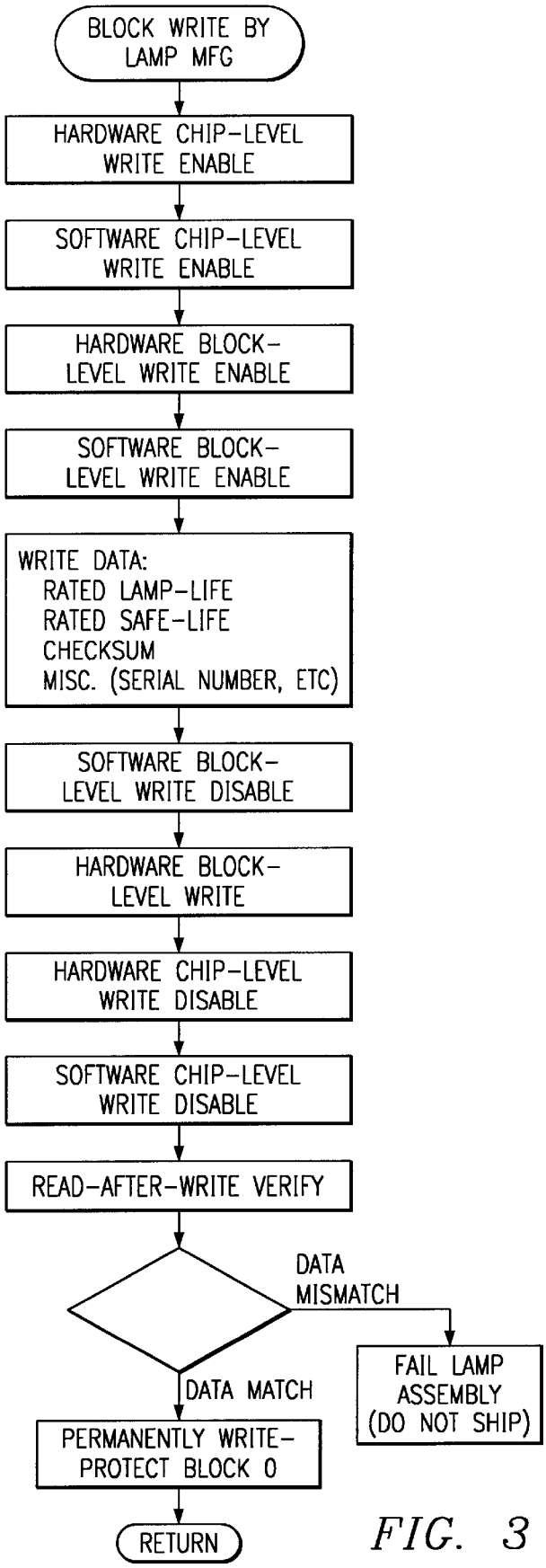
FIG. 3 is a flowchart of an EEPROM write sequence used by the lamp manufacturer during the assembly and testing of the lamp.
Figure 4:
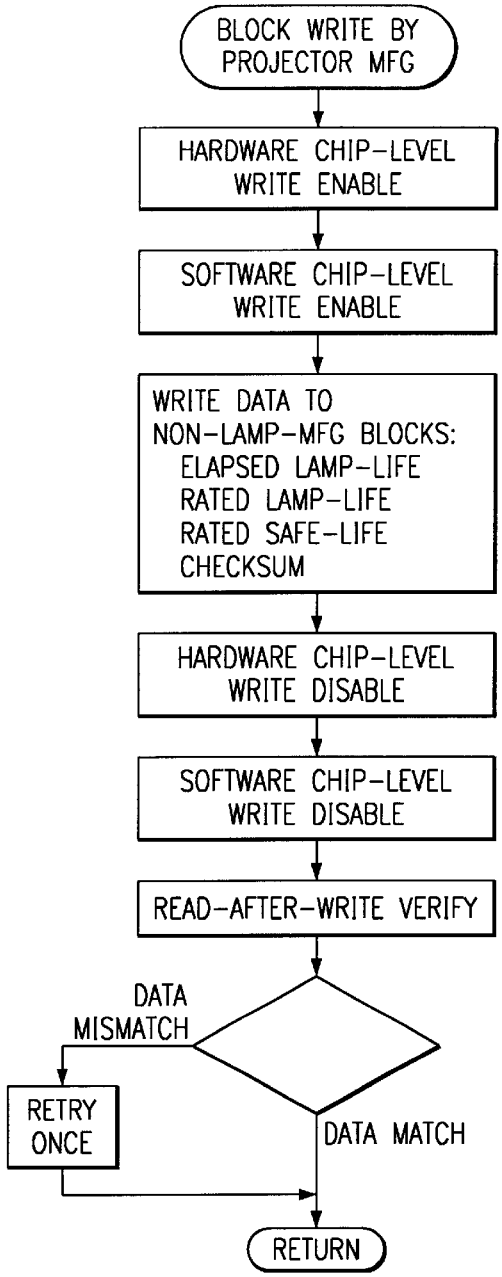
FIG. 4 is a flowchart of an EEPROM write sequence used by the display projector to update the accumulated hours.

FIG. 3 is the write sequence used by the lamp manufacturer. After enabling write operations through both hardware and software setup routines, the rated lamp life, serial number, and any additional information is stored in Block 0 of the EEPROM. The hardware and software write enables are then removed, and the data written to the EEPROM is verified. If the EEPROM verifies, one-time write protection to Block 0 is enabled—preventing further write operations to Block 0.

A majority of the remainder of the EEPROM is used to store copies of the rated safe life of the lamp, and copies of the elapsed operational time for the lamp. These copies can be written to the EEPROM initially by the lamp manufacturer, or they may be created by the display projector the first time the projector is used. These extra copies are key to increasing the reliability of the lamp timer. As mentioned above, the EMI generated during the ignition of the lamp can re-write memory locations. The additional copies are used to replace the values in Block 0 if Block 0 is overwritten, and to determine the intended data values if all of the blocks are corrupted.

Figure 2A:
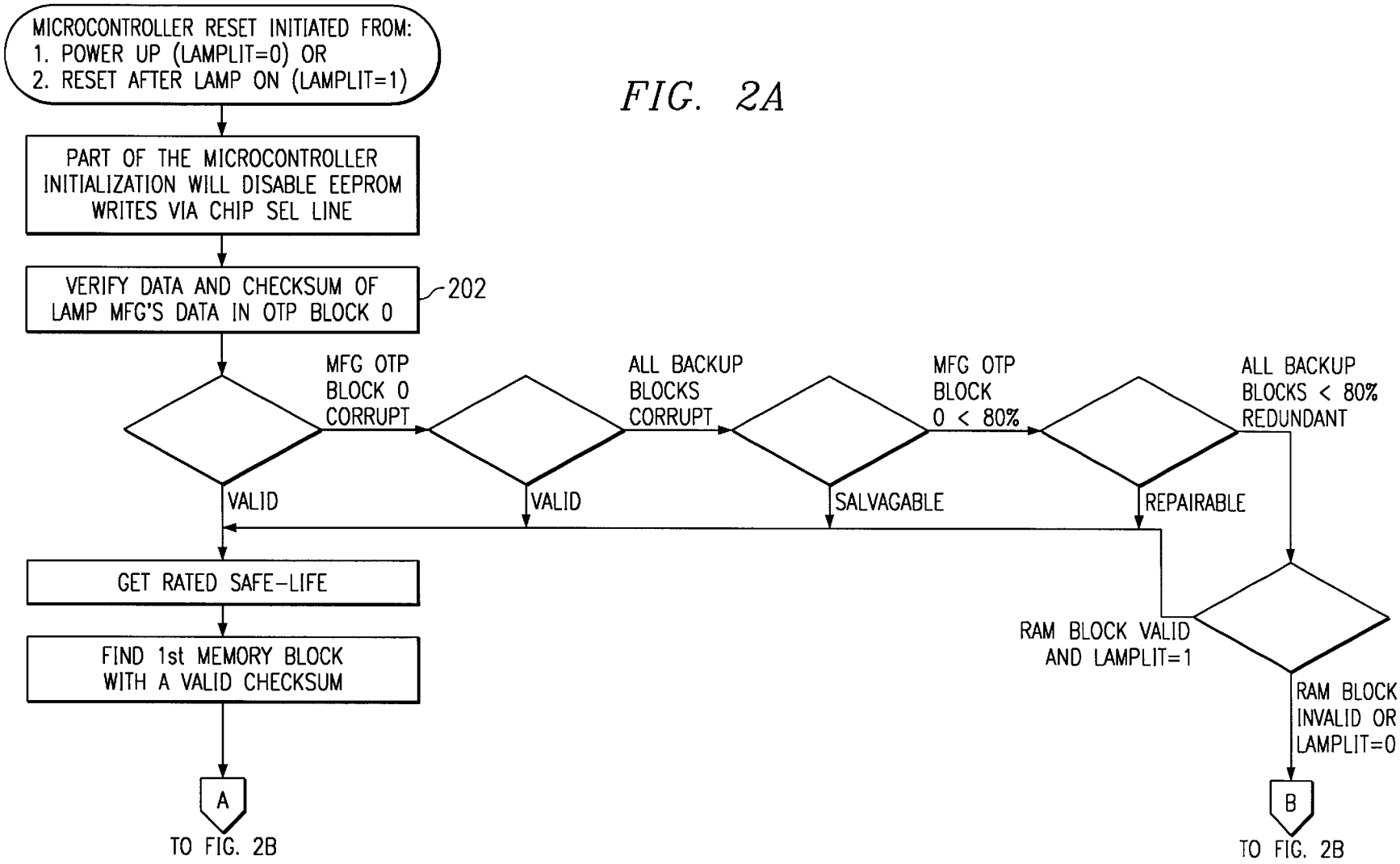
FIG. 2 is a flowchart showing the operation of the lamp life timer controller of FIG. 1.
Figure 2B:
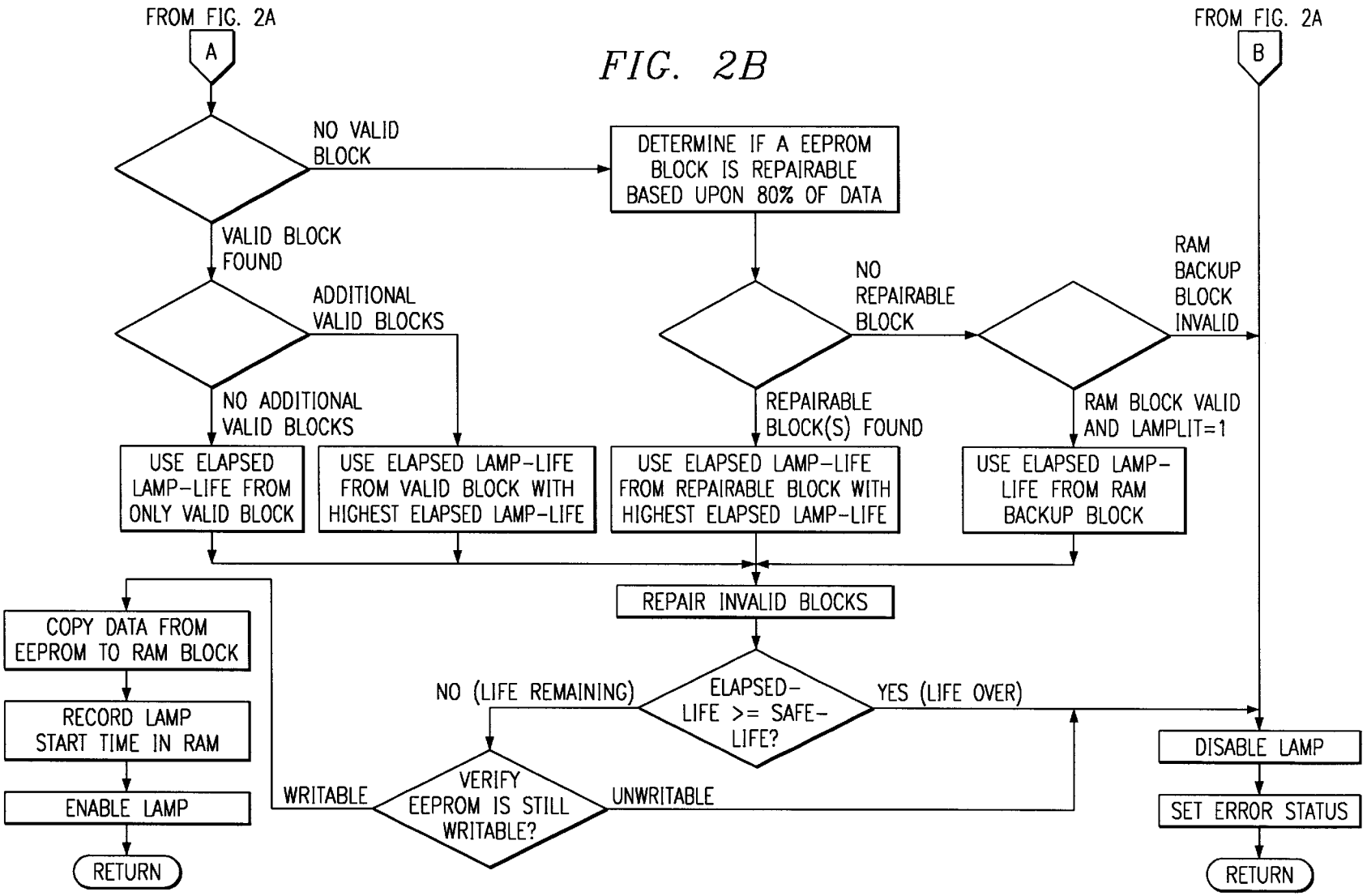

FIG. 2 is a flowchart of the operation of the timer controller 106. In block 202, the controller reads rated safe life data from EEPROM Block 0 and verifies the checksum value. If the data is valid, a copy is stored in a local RAM backup memory 110 which is assumed to be less susceptible to the EMI generated by the lamp since the backup memory is farther from the lamp. The valid data value is later used to repair any EEPROM blocks corrupted by ignition of the lamp. If the data is invalid, the backup values stored in the EEPROM are read and compared to the checksums. If valid data is found in any of the backup locations, that data is used.

If all of the EEPROM blocks are corrupted, the timer controller polls the EEPROM a second time, counting the number of identical data words. If a sufficient number of the duplicated values in a given block are equal, for example at least eighty percent, the value is assumed to be correct that the data value is used as the rated safe life.

After the rated safe life is determined, the timer controller reads the memory and verifies the checksums to determine the elapsed operational time of the lamp. If two or more blocks have valid checksums and different elapsed time values, the greater of the two or more valid data values is used. If none of the EEPROM memory blocks have valid checksums, the timer controller once again attempts to find the same value in a large percentage of the redundant locations. If a sufficient number of the duplicated values in a given block are equal, the value is assumed to be correct and the data value is used as the elapsed operational time of the lamp.

After the rated safe life and elapsed operational time of the lamp are determined, any corrupted memory blocks are repaired. The elapsed time and rated safe life are compared.

If there is remaining operational life, the ability to write to the EEPROM is verified. This write check ensures the timer controller will be able to update the elapsed time stored in the EEPROM. If the write test passes, the lamp start time is recorded in RAM and the lamp is enabled. No read or write operations are allowed during the ignition process since the EMI could corrupt the data.

When the power good signal, PWRGOOD, is false, the lamp is disabled and the microcontroller is reset. Therefore, any time the power drops out, the lamp will be disabled. Ideally the entire process shown in FIG. 2 executes within one-half second. Executing the entire routine in one-half second or less ensures that the lamp will be enabled at the end of the lamp ignition process. This is important because the EMI pulse caused by ignition can clear the software controlled register that enables the lamp. If the register is cleared, the lamp will go out at the end of the half-second ignition period unless the routine has run and reset the register.

Returning to FIG. 1, when the power-up check is complete, the timer controller enables the lamp power supply 108 using signal LAMPEN. Once the lamp is ignited, a lamp lit signal, LAMPLIT, is driven to the timer controller 106. The rising edge of LAMPLIT generates a reset signal that ensures the timer controller 106 is operating in a known state following the EMI generated by the ignition.

Figure 5:
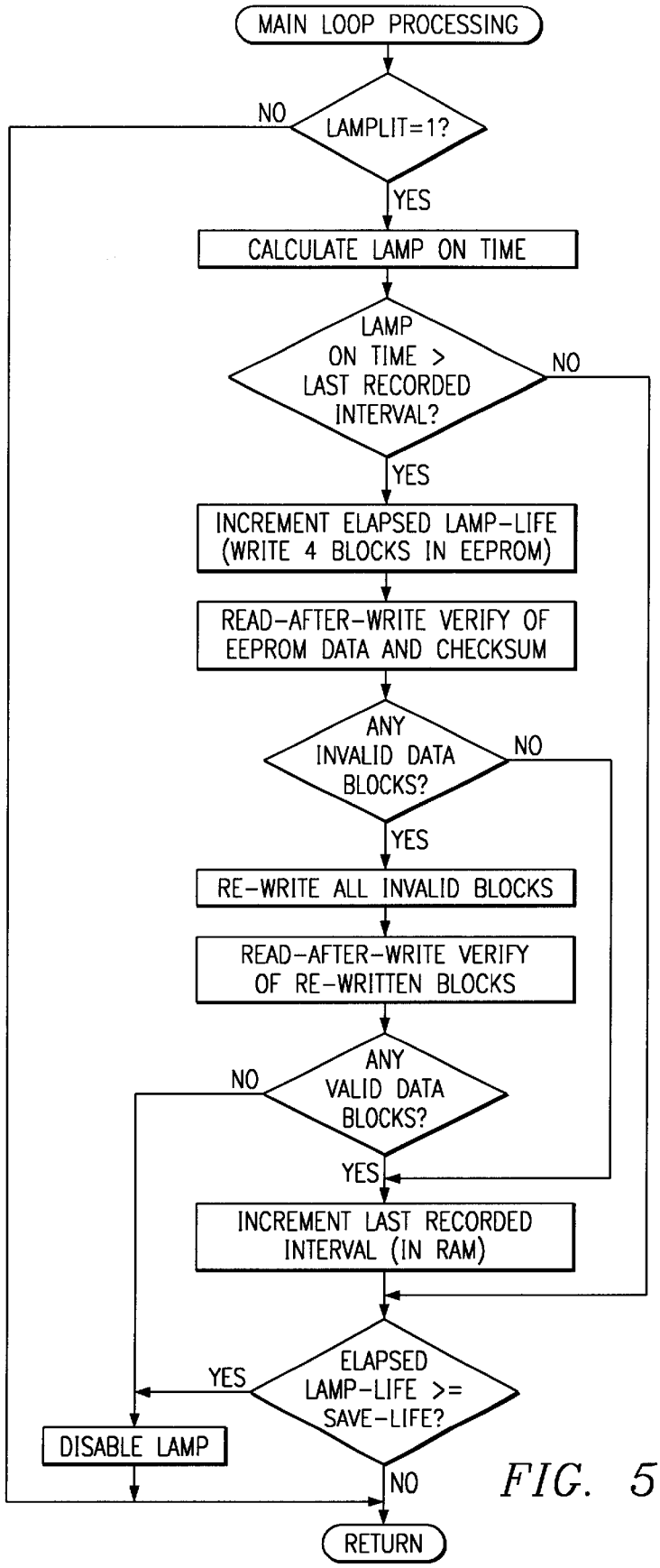
FIG. 5 is a flowchart of the main processing loop used by the controller.

Once the lamp is ignited and any EEPROM errors that can be repaired have been repaired, the timer controller executes the operations shown in FIG. 5. The timer controller typically is a low-cost microcontroller that performs many other system functions—thus the additional projector cost due to implementation of the disclosed method is very low. The flowchart of FIG. 5 shows that the timer controller periodically calculates the time the lamp has been on since the last update. When the on time since the last update exceeds a threshold incremental value, new elapsed times are written to the EEPROM in many redundant locations.

The new values written into the EEPROM are verified. If invalid blocks are found, they are rewritten and re-verified. If none of the blocks will hold correct data, the lamp is disabled. Once the correct data has been verified in at least one block, the last increment is recorded in RAM. The elapsed time is then compared to the rated safe life of the lamp. If the rated safe life of the lamp exceeds the elapsed time stored in the EEPROM, the timer will wait until the time since last update once again exceeds the threshold incremental value before repeating the steps of FIG. 5. If the elapsed time does exceed the rated safe life of the lamp, the timer controller disables the lamp.

Of course, other embodiments of the lamp timer are readily thought of. For example, the rated safe life value can be used as the initial elapsed time value and the elapsed time value periodically decremented until it reaches zero. According to this embodiment, when the elapsed time value reaches zero the lamp is disabled. Other embodiments warn the user a predetermined time before the lamp is disabled.

FIG. 6 is a schematic view of an image projection system 600 implementing a lamp timer according to the present invention. In FIG. 6, the timer controller circuitry inside the display system controller 614 reads information from the lamp 604 as described above and, if the lamp has any remaining life, ignites the lamp arc. Light from lamp 604 is focused on a micromirror device 602, or other spatial light modulator, by lens 606. Although shown as a single lens, lens 606 is typically a group of lenses and mirrors which together focus and direct light from the lamp 604 onto the surface of the micromirror device 602. Image data and control signals from controller 614 cause some mirrors to rotate to an on position and others to rotate to an off position. Mirrors on the micromirror device that are rotated to an off position reflect light to a light trap 608 while mirrors rotated to an on position reflect light to projection lens 610, which is shown as a single lens for simplicity. Projection lens 610 focuses the light modulated by the micromirror device 602 onto an image plane or screen 612.

Thus, although there has been disclosed to this point a particular embodiment for a high reliability timer and method therefore etc., it is not intended that such specific references be considered as limitations upon the scope of this invention except insofar as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims.

What is claimed is:

1. A method of tracking the elapsed operating time of a light source, the method comprising the steps of:

associating a memory device with a lamp, said memory having a rated safe life value stored therein;

igniting said lamp;

updating an elapsed lamp on time value stored in said memory;

comparing said elapsed lamp on time to said rated lamp life value;

repeating said updating and comparing steps until said elapsed lamp on time exceeds said rated safe life value; and disabling said lamp when said elapsed lamp on time exceeds said rated safe life value.

2. The method of claim 1, said rated safe life value stored in multiple locations of said memory device, further comprising the steps of:

comparing said multiple locations; and rewriting inaccurate locations.

3. The method of claim 1, said elapsed lamp on time value stored in multiple locations of said memory device, further comprising the steps of:

comparing said multiple locations; and rewriting inaccurate locations.

4. The method of claim 1, said memory device logically divided into at least two blocks, further comprising the step of:

verifying a checksum associated with one of said blocks.

5. The method of claim 1, said method further comprising the step of write protecting a group of locations in said memory after writing said rated safe life value therein.

6. The method of claim 1, said method further comprising the steps of:

reading a potentially corrupt rated safe life value from all locations where said rated safe life value is stored; and setting said rated safe life value equal to the most common potentially corrupt rated safe life value read.

7. The method of claim 1, said method further comprising the steps of:

reading a potentially corrupt rated safe life value from all locations where said rated safe life value is stored; and disabling said lamp if at least a predetermined percentage of said potentially corrupt rated safe life values are not equal.

8. The method of claim 1, said method further comprising the steps of:

reading a potentially corrupt elapsed lamp on time value from all locations where said elapsed lamp on time value is stored; and disabling said lamp if at least a predetermined percentage of said potentially corrupt elapsed lamp on time values are not equal.

9. The method of claim 1, said method further comprising the steps of:

reading a potentially corrupt elapsed lamp on value from all locations where said elapsed lamp on time value is stored; and disabling said lamp if at least a predetermined percentage of said potentially corrupt elapsed lamp on time values are not equal.

10. A display system comprising:

a lamp for generating a beam of light along a light path, said lamp having a rated safe life value;

a memory device associated with said lamp, said rated safe life value stored in said memory;

a timer controller circuit, said timer controller circuit capable of reading said rated safe life value from said memory and storing an elapsed lamp on time value in said memory, said timer controller circuit disabling said lamp when said elapsed lamp on time value exceeds said rated safe life value, and disabling said lamp when either said elapsed lamp on time value or said rated safe life value become irretrievably corrupted;

a spatial light modulator on said light path for modulating said beam of light to produce a modulated beam of light; and projection optics to focus said modulated beam of light on an image plane.

* * * * *